United States Patent [19]

Matsumoto et al.

[11] Patent Number: 4,488,023

[45] Date of Patent: Dec. 11, 1984

[54] ROTARY-ARC TYPE GAS-FILLED SWITCH

[75] Inventors: Kenichi Matsumoto; Mashakatsu Goto; Kiyoshi Yomura, all of Yukuhashi; Masao Otsuka, Kitakyushu; Koichi Hori, Kitakyushu; Yoshiyuki Okamura, Kitakyushu, all of Japan

[73] Assignee: Yaskawa Electric Mfg. Co., Ltd., Kitakyushu, Japan

[21] Appl. No.: 451,730

[22] Filed: Dec. 20, 1982

[30] Foreign Application Priority Data

Dec. 30, 1981 [JP] Japan ..... 56-210407

[51] Int. Cl.[3] ..... H01H 33/18

[52] U.S. Cl. ..... 200/147 R; 200/147 A; 200/148 R

[58] Field of Search ..... 200/147 R, 147 A, 147 B

[56] References Cited

FOREIGN PATENT DOCUMENTS 834018 5/1960 United Kingdom ..... 200/147 A

*Primary Examiner*—A. D. Pellinen
*Assistant Examiner*—Morris Ginsburg
*Attorney, Agent, or Firm*—James J. Ralabate

[57] ABSTRACT

A gas-filled switch with an improved arc extinguishing characteristics. Such gas-filled switch comprises a gas-filled casing, a pair of electrodes disposed in the casing, a conductive retaining ring which encircles at least one of the electrodes, a permanent magnet of a cylindrical configuration mounted in the retaining ring, a conductive cylindrical body disposed in one end opening of the retaining ring, and an arc-drive coil encircling the conductive cylindrical body and having one end connected to the conductive cylindrical body and other end connected to the electrode. Due to such construction, one root of an arc generated between the electrodes is moved from one electrode to the conductive cylindrical body so that the other root of the arc is subjected to the magnetic flux of the permamemt magnet while the previous one root of the arc is subjected to the magnetic flux of the arc-drive coil so as to extinguish the arc during the rotation of the arc.

1 Claim, 4 Drawing Figures

ROTARY-ARC TYPE GAS-FILLED SWITCH

BACKGROUND OF THE INVENTION

This invention relates to a gas-filled switch which can accurately switch on and off a circuit of a distorted wave which includes higher harmonics.

In conventional gas-filled switches, an electromotive force which is generated by an arc current which flows in an arc-drive coil is utilized to rotate the arc so as to extinguish the arc during the rotation of the arc. In such operation, the drive force which rotates the arc is determined by the crest value of the arc current. This implies that the greater the arc current, the greater arc drive force is produced and the arc-extinguishing ability also becomes improved. The arc-extinguishing ability of the arc drive coil is usually designed in view of a case where the arc current is a sinosoidal wave. Therefore, in a circuit which has a thyrister rectifier in the load side by of the transformer, the arc current is small and the gradient of the sinosoidal curve from the zero level becomes sharp. Accordingly, the arc-extinguishing ability of the arc drive coil is small and the phase relationship between the arc current and the magnetic force becomes remote from the predetermined value so that the switching operation often becomes impossible.

Accordingly, it is an object of the present invention to provide a gas-filled switch which can overcome above-mentioned defects of conventional switches.

The present invention, in summary, discloses a gas-filled switch with an improved arc extinguishing characteristics. Such gas-filled switch comprises a gas-filled casing, a pair of electrodes disposed in the casing, a conductive retaining ring which encircles at least one of the electrodes, a permanent magnet of a cylindrical configuration mounted on the retaining ring, a conductive cylindrical body disposed in one end opening of the retaining ring, and an arc-drive coil encircling the cylindrical body and having one end connected to the conductive cylindrical body and other end connected to the electrode. Due to such construction, one root of an arc generated between electrodes is moved from one electrode to the cylindrical body so that the other root of the arc is subjected to the magnetic flux of the permanent magnet while the previous one root of the arc is subjected to the magnetic flux of the arc-drive coil, whereby the arc is effectively extinguished during the rotation thereof.

DETAILED DESCRIPTION OF THE DISCLOSURE

Figure 1:
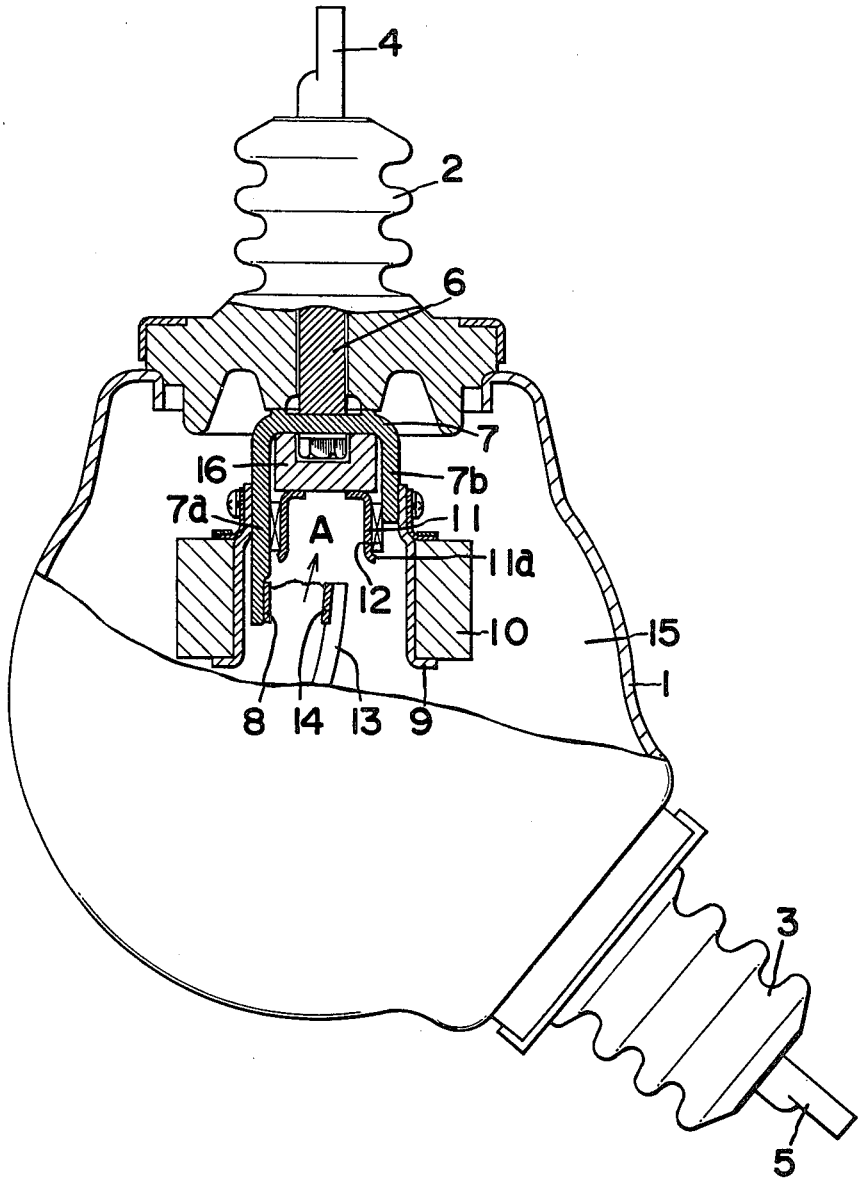
FIG. 1 is a side view with a part broken away of one embodiment of the gas-filled switch of the present invention.

The gas-filled switch of the present invention is hereinafter disclosed in detail in conjunction with the attached drawings.

In the drawings, numeral 1 indicates a casing, numerals 2 and 3 indicate insulators, numerals 4 and 5 indicate outer terminals, numeral 6 indicates a conductive element connected to the outer terminal 4, numeral 7 indicates an inverse-U-shaped stationary electrode connected to one end of the connecting conductive element 6. The stationary electrode 7 is provided with a stationary contact 8 at one leg *7a* thereof. Numeral 9 indicates a retaining ring which is made of conductive material and is attached to the legs *7a, 7b* of the stationary electrode 7. A permanent magnet 10 is fixedly mounted on the outer periphery of the retaining ring 9. Numeral 11 indicates a conductive cylindrical body which has the lower end thereof extended radially to form a flange 11*a* and the upper end thereof attached to the stationary electrode 7 by way of an insulating seat 16. Numeral 12 indicates an arc-drive coil which encircles the cylindrical body 11 and has one end thereof connected to the cylindrical body 11 and other end thereof connected to the stationary electrode 7. Numeral 13 indicates a movable electrode provided with a movable contact 14. Numeral 15 indicates an extinguishing gas filling the casing 1.

Figure 2:
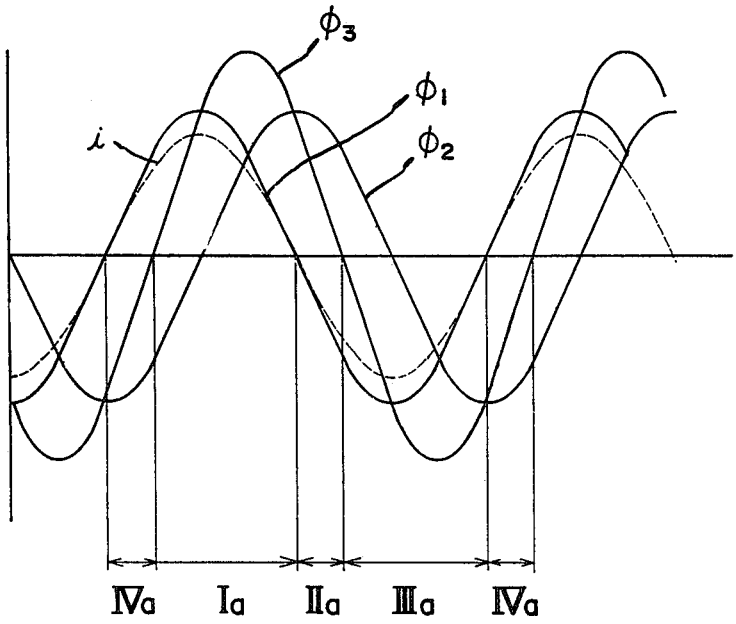
FIG. 2 is a wave form diagram showing the change of an arc current and various magnetic fluxes.
Figure 3:
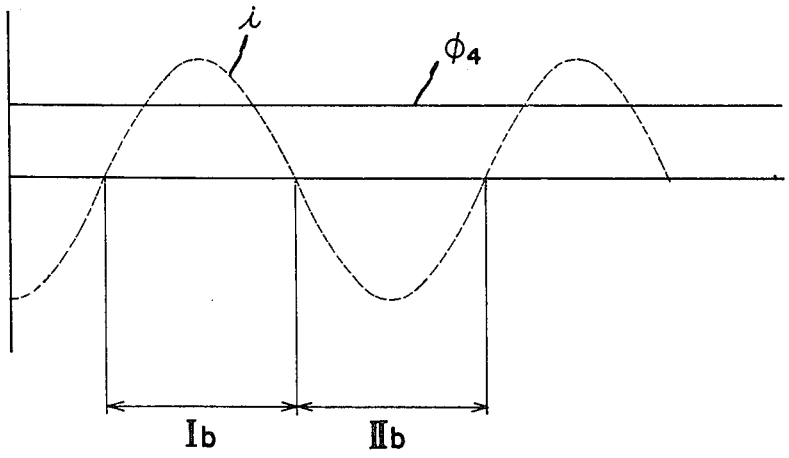
FIG. 3 is a wave form diagram showing the change of an arc current and the magnetic flux of the permanent magnet.
Figure 4A:
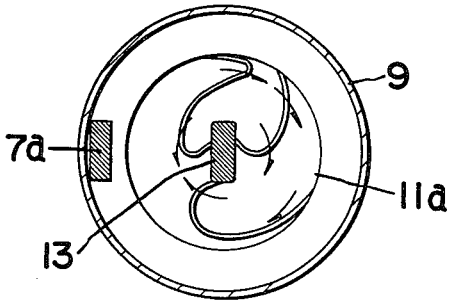
FIG. 4 is an explanatory view showing a rotating arc, wherein (a) shows the arc when the current is positive and (b) shows the arc when the current is negative.
Figure 4B:
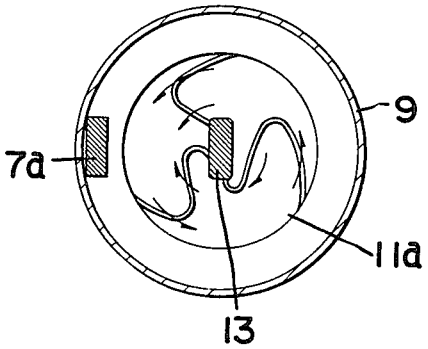

When an operation signal is given to an operating mechanism (not shown in the drawing) to open the switch, an operating shaft (also not shown in the drawing) is rotated so as to separate the movable contact 14 on the movable electrode 13 from the stationary contact 8 on the stationary electrode 7. An arc is generated between the contacts 8 and 14 upon such separation. The arc current flows from the outer terminal 4 to the stationary electrode 7 through the connecting electrode 6, and subsequently flows from the stationary contact 8 on one leg *7a* of the stationary electrode 7 to the movable contact 14 passing through the arc-extinguishing gas 15 and finally flows to the outer terminal 5 by way of the movable electrode 13 to define an arc current circuit. Due to the magnetic flux $\phi_4$ of the permanent magnet 10 which encircles the above two contacts 8 and 14, the arc disposed between two contacts 8 and 14 is driven in a direction parallel to the periphery of the permanent magnet 10 after the generation of the arc, and the root on the stationary contact 8 is moved onto the retaining ring 9 so as to rotate the arc in the arc-extinguishing gas atmosphere which is defined between retaining ring 9 and the movable electrode 13. When the arc current i is small due to the extinguishing capacity of the arc-extinguishing gas, the arc current soon becomes zero so that the switch is opened. However, when the arc current is large, even when the arc current reaches zero level, the arc is again generated and the root of the arc rotates in the annular arc-extinguishing gas atmosphere defined between the retaining ring 9 and the movable contact 13, and such root also moves toward the flange 11*a* of the cylindrical body 11 by the driving force working in a direction A caused by the self-current path which flows from the retaining ring 9 to the movable electrode 13 passing through the above arc-extinguishing gas atmosphere. The arc current i flows from the outer terminal 4 to the arc drive coil 12 by way of the connecting conductive body 6 and the leg *7a* of the stationary electrode 7, subsequently flows from the cylindrical body 11 to the outer terminal 5 by way of the flange 11*a*, the arc-extinguishing gas atmosphere and the movable electrode 13 to define a current circuit. The magnetic flux $\phi_1$ is generated by the arc current i which flows the above arc drive coil 12, while this magnetic flux $\phi_1$ causes the cylindrical body 11 to provide the secondary current which induces the magnetic flux $\phi_2$. Such magnetic fluxes $\phi_1$ and $\phi_2$ are combined to form a combined magnetic flux $\phi_3$. This combined magnetic flux $\phi_3$ works on the root on the flange 11*a* of the cylindrical body 11 and on the arc adjacent to the flange 11*a*, while the magnetic flux $\phi_4$ generated by the permanent magnet 10 works on the root of the arc on the movable electrode 13 and on the arc adjacent to the movable electrode 13. The magnetic flux $\phi_4$ of the permanent magnet 10 works such that, as shown in FIG. 3, the arc is rotated by reversing the rotating direction at each half cycle Ib, IIb corresponding to the direction of the arc current and the direction of the magnetic flux. The combined magnetic flux $\phi_3$ works such that, as shown in FIG. 2, the arc reverses the rotation thereof at each interval, namely Ia, IIa, IIIa, IVa corresponding to the flow direction of the arc current and the flux direction of the combined magnetic flux $\phi_3$. Therefore, the arc is elongated and contracted by the above effect of the combined magnetic flux $\phi_3$ and the magnetic flux $\phi_4$ of the permanent magnet 10, and is rotated between the cylindrical body 11 and the movable electrode 13 forming a spiral. During the above rotation, the arc is extinguished due to the cooling thereof and the electro-absorption effect. FIG. 4 shows the arc in a rotating condition, wherein the arc current is positive in (a) and the arc current is negative in (b).

As has been described heretofore, the gas-filled switch of the present invention comprises the gas-filled casing, a pair of electrodes disposed in the casing, the conductive retaining ring which encircles at least one of the electrodes, the permanent magnet of a cylindrical configuration mounted on the retaining ring, the conductive cylindrical body disposed in one end opening of the retaining ring, and the arc-drive coil encircling the conductive cylindrical body and having one end connected to the conductive cylindrical body and other end connected to the electrode. Due to such construction, a root of an arc generated between two electrodes is moved from one electrode to the conductive cylindrical body so that the other root of the arc is subjected to the magnetic flux of the permanent magnet while the first one root of the arc is subjected to the magnetic flux of the arc-drive coil so as to extinguish the arc during the rotation of the arc. Therefore, at least either the magnetic flux of the permanent magnet or the magnetic flux of the arc-drive coil is always working on the arc so that the arc can be always under control. Furthermore, since the arc is rotated in such a manner that the arc is elongated and contracted by the magnetic flux of the permanent magnet and the magnetic flux of the drive coil, the arc can be effectively extinguished.

What we claim is:

1. A rotary-arc type gas-filled switch comprising (a) a gas-filled casing, (b) a pair of stationary and movable electrodes disposed in said casing, (c) a conductive retaining ring which encircles at least one of said electrodes, (d) a permanent magnet of a cylindrical configuration mounted on said retaining ring, (e) a conductive cylindrical body disposed in one end opening of said retaining ring, and (f) an arc-drive coil encircling said conductive body, said arc-drive coil having one end connected to said conductive cylindrical body and other end connected to said stationary electrode, whereby, one root of an arc, which is generated between said electrodes upon moving said movable electrode from said stationary electrode laterally toward said retaining ring, is moved from said one electrode to said conductive cylindrical body so that other root of said arc is subjected to a magnetic flux of said permanent magnet while said one root of said arc is subjected to the magnetic flux of said arc-drive coil so as to extinguish said arc during the rotation of said arc.

* * * * *